US006032816A

United States Patent [19]

Martin

[11] Patent Number: 6,032,816

[45] Date of Patent: Mar. 7, 2000

[54] CAP FOR CLOSING A CONTAINER HAVING A BREAKABLE SEAL

[75] Inventor: Didier Martin, Cran Gevrier, France

[73] Assignee: Akline, Chavanod, France

[21] Appl. No.: 09/214,119

[22] PCT Filed: Jun. 26, 1997

[86] PCT No.: PCT/FR97/01142

§ 371 Date: Dec. 28, 1998

§ 102(e) Date: Dec. 28, 1998

[87] PCT Pub. No.: WO98/00345

PCT Pub. Date: Jan. 8, 1998

[30] Foreign Application Priority Data

Jun. 28, 1996 [FR] France ..... 96 08101

[51] Int. Cl.[7] ..... B65D 41/56

[52] U.S. Cl. ..... 220/212; 220/258; 220/269; 220/284

[58] Field of Search ..... 220/212, 212.5, 220/243, 251, 254, 256, 258, 259, 269, 284, 287, 314

[56] References Cited

U.S. PATENT DOCUMENTS

| | | | |
|---|---|---|---|
| 4,387,826 | 6/1983 | Heubl | 220/243 |
| 4,511,057 | 4/1985 | Tontarelli | 220/314 X |
| 4,917,258 | 4/1990 | Boyd et al. | 220/240 |
| 5,285,924 | 2/1994 | Morris . | |
| 5,351,853 | 10/1994 | Shock | 220/279 |
| 5,842,594 | 12/1998 | Ibara | 220/314 |

FOREIGN PATENT DOCUMENTS

| | | |
|---|---|---|
| 0 558 422 | 9/1993 | European Pat. Off. . |
| 2 728 237 | 6/1996 | France . |
| 39 31 573 | 4/1991 | Germany . |
| 2 185 613 | 7/1987 | United Kingdom . |

*Primary Examiner*—Stephen K. Cronin
*Attorney, Agent, or Firm*—Young & Thompson

[57] ABSTRACT

The invention concerns a cap (8) for closing a container such as a drink can opened (6) by a breakable seal (5) by means of a pull strip (7) on the lid, the said cap (8) being removably mounted on or around the said pull strip (7) to constitute a movable tab pivoting about the rivet (9) on the lid (4) to be clipped on the peripheral lip (12) crimping the lid (4) on the body (1) of the container. It is characterised in that the clipping means comprise two resilient linking tabs (13, 14) symmetrically arranged in the median horizontal plane P of the cap (8) on either side of the longitudinal axis of symmetry S to form a space (15) in which a lug (16) extends from a horizontal strip (17) holding together the two release tabs (13, 14). The invention also concerns the use of the cap (8) as an advertising vector or an element of a game.

12 Claims, 2 Drawing Sheets

CAP FOR CLOSING A CONTAINER HAVING A BREAKABLE SEAL

This invention relates to a device for closing receptacles with a permanent opening, particularly such as soft drink or similar cans, in accordance with the preamble in the first claim. The invention also relates to a specific use of the device as a means of communication and more particularly as an advertising medium.

A device for reclosing a receptacle is already known, consisting of a cylindrical body, a bottom and a top, in which an opening smaller than the top can be formed by means of a frangible closing device inside the receptacle by means of a lever formed by a pulling tab held in place at the center and above the said top by a rivet, which beneficially replaces earlier solutions such as other tops arranged on the top of some cans of preserves or some pharmaceutical products that are to be reclosed after initial opening, or replacement of other systems including a device essentially composed of a metal or plastic sector that tops the orifice in the receptacle by pressure, by forcing an overthickness into the said orifice.

This closing device is characterized in that it is composed of a cover removably mounted on or around the pulling tab before or after the receptacle is opened, to form a mobile cleat pivoting about the rivet on the upper part of the top, the said cover being fixed firstly on the said pulling tab and secondly, due to suitably shaped outside peripheral edges, clipping around the peripheral hem crimping the top on the receptacle body, this hem acting as an outside rail for circular displacements of the cover.

A European patent EP.0558422 was filed for this device on 26.02.1993 in the applicant's name, with a major disadvantage essentially related to its manufacturing process.

The top view of the outside edge of the cover is in the shape of an angular sector in order to clip onto the hem of the receptacle; furthermore for correct clipping, it was necessary that the transverse section of the said edge should generally cover more than half an arc of a circle, i.e. the angular sector should exceed 180°; these two conditions were essential to operation of the device according to the patent, although this configuration is practically and above all economically incompatible with molding in two parts without a moving part except for a slide to form the housing in which the pulling tab will be located. Under these conditions, the mold removal operation after injection of the plastic material into the mold cavities cannot be done without forcing, i.e. by taking advantage of the material resilience to release the device from its cavity; due to the sector shape, and the need for the sector to occupy more than a half of a circle, it is almost impossible to remove it from the mold by forcing without going beyond the resilient limits of the material, i.e. without irreversibly modifying its modulus of resilience which is detrimental to correct subsequent operation expected from the product.

As it was not reasonable to economically consider molding in several directions, or to provide molds with slides or half-slides following the arc of a circle which would unacceptably increase the cost, it became necessary to make a substantial modification to the locking technique related to the device to permanently overcome the disadvantages mentioned above.

In this respect, and in accordance with the main purpose of the invention, a reclosing cover for a receptacle consisting of a cylindrical body, a bottom and a crimped top is provided, in which an opening may be formed smaller than the said top itself, by means of a frangible closing device known per se, that can be pushed inside the receptacle by the lever effect of a pulling tab fixed in the center and above the said top by a rivet, the said cover being installed removably on or around the said pulling tab before or after opening the receptacle, to form a mobile cleat pivoting around the said rivet on the upper part of the top which firstly fits on the said pulling tab and secondly, through external peripheral means, clips around the peripheral crimping hem on the top on the receptacle body to act as an external rail during circular displacements of the cover, the said cover being characterized in that external peripheral means comprise at least two resilient connecting tabs laid out approximately in the median horizontal plane of the cover and symmetrically arranged on each side of the longitudinal axis of symmetry of the said cover extending along a radius of the top, to form a space between two successive connecting tabs in which a stud projecting from a horizontal strip connecting the free mold removal ends of the said connecting tabs extends from the internal edge of the said strip towards the lower part of the hem until it comes in contact with the side wall of the receptacle in order to lock the receptacle in combination with the said connecting tabs, and also to provide guidance around the hem during circular displacements of the cover.

Based on these improvements, it is clear that it is now possible to obtain a reclosing cover in accordance with the invention by means of simple molds and counter molds, and in any case without any mobile part other than a central slide designed to form the housing for the pulling tab. Thus, large numbers of products can be produced at high speed, without the need for forced mold removal causing serious damage to elements participating in the clipping, as mentioned above.

Unexpectedly, providing two connecting tabs containing a clipping device instead of one continuous clipping device, means that the reclosing cover can be widened as much as required, such that unexpectedly and beneficially, at least the upper surface of these reclosing covers can be used as a means of communication, for example as a support for advertising type messages.

This type of cover already forms an advertising object in itself, particularly when it is provided with a purchased drink; it thus appeared useful to use the available surface corresponding with at least the upper surface of the said cover when it is installed on the receptacle top for silk screen printing, printing, engraving messages, for example for advertising purposes. It is easy to understand the advantage of this type of use in the marketing field.

Furthermore, and according to another characteristic of the invention, a male element is provided which projects from the internal peripheral edge along the extension of the upper surface of the cover and along its longitudinal axis of symmetry, to cooperate by acting as a lever with the pulling tab to facilitate opening by penetration of the frangible area of the top; surprisingly, this male element beneficially contributes to reinforcing the advertising function of the cover in that it can easily cooperate with the two connecting tabs of a second reclosing cover which is also designed to form a continuous chain of covers for games or advertising purposes.

According to another complementary feature of the invention, the two side faces of the reclosing cover according to the invention can be used to form horizontal slits into which the male parts of one or several covers of the type described above can be fitted; means such as overthicknesses and retaining pins are also provided at the end of the male part for attachment forwards or backwards and for hinging into one or an arbitrary sequence of covers, in 2-dimensional or 3-dimensional space.

Other advantages and characteristics will be better understood from the following description of an embodiment example of a reclosing cover for a drink can type receptacle fitted with a top with a frangible and permanent opening, which is obviously only a non-limitative example of the invention with reference to the appended drawings in which.

Figure 4A:
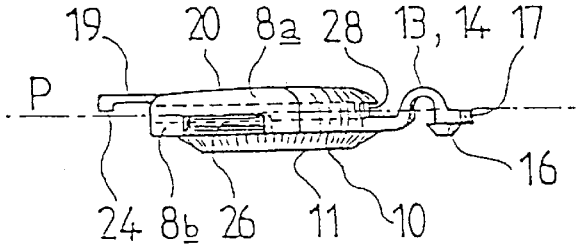
FIG. 4 is a side view of the cover in accordance with the invention, with two variants.
Figure 5:
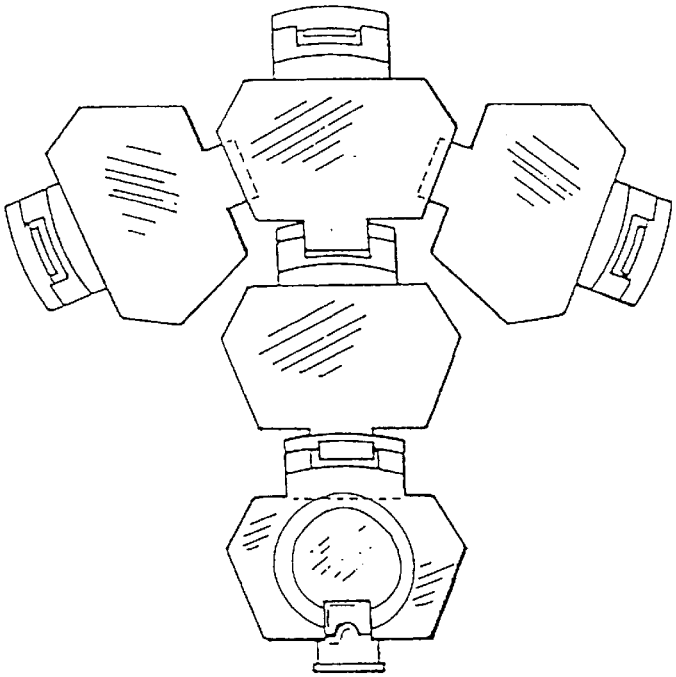
Figure 6:
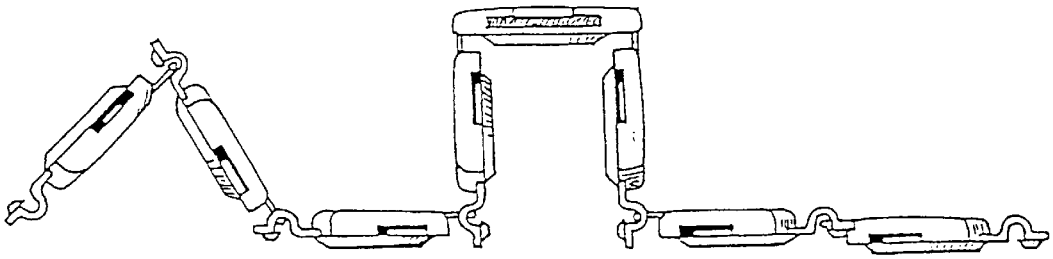

in 4*a*, without inner stud, in 4*b* with inner stud, the rest of the Figure is identical to FIG. 4*a* and has not been shown;

FIG. 5 shows a first example of the combination of several covers according to the invention in a plane mosaic;

FIG. 6 is another example of a threedimensional combination of covers, shown diagrammatically.

With reference to FIGS. 1 to 4, the following will describe an alternative embodiment of a reclosing cover in accordance with the invention, for example designed for use for drinking cans. These receptacles generally have a cylindrical body 1 and bottom 2 usually obtained by stamping a flat piece of mild steel or aluminum in a single pass, narrowing 3 being done later close to the upper edge of the said body, in particular to facilitate stacking receptacles on top of each other. A top 4 is fixed onto this narrowing 3 by crimping, in which a frangible closing device 5 is formed which, once torn along the line of least resistance provided for this purpose, creates an opening 6 through which the drink can flow out of the receptacle. The frangible closing device 5 is usually broken by means of a pulling tab 7; this pulling tab is riveted at the center and above the top 4 and its lever effect pushes closing device 5 inside the receptacle before returning naturally to its initial position.

According to the invention, the opening 6 is closed using a cover 8 usually in the shape of an angular sector (although this shape is not compulsory) made by injection of a plastic inside a mold and a counter-mold designed to produce the said covers in large quantities.

Each cover 8 comprises an upper surface and a lower surface that are supported on the top 4 connected through side walls (right 8*a* and left 8*b*) and peripheral walls (outside 8*c* and inside 8*d*) that are approximately vertical and surround pulling tab 7; the pulling tab is pivotally mounted on the top 4 around a central rivet 9. Once the closing device 5 is pushed in, with or without the assistance of cover 8 as will be described later, to reclose opening 6 formed in this way, the lower face 10 of the cover 8 is rotated about rivet 9 to coincide with the edges of opening 6. For example, the required relative tightness can be obtained with a material forming the said lower face 10, which is normally flexible, coming into contact with opening 6 like a sliding joint; according to one preferable alternative of the invention, a bossing 11 is provided on the lower surface 10 of the cover 8, with an external perimeter slightly smaller than the area of the opening 6, such that the said bossing 11 fits precisely in the opening 6.

It is well known that the reclosing cover 8 is designed to be placed removably onto pulling tab 7 of the closing device 5; however, and in accordance with the teachings of European patent EP-0558422 mentioned above, the cover 8 is held in place firstly by being fixed to tab 7 as mentioned above, and secondly by clipping means projecting from the outside peripheral surface 8*c* of the cover 8 which fits into the crimping hem 12 of the top 4 on the receptacle body 1; the hem 12 with a substantially circular section extends all around said top 4, beneficially providing a rail for circular displacement of the cover around the rivet 9.

The means of connecting cover 8 on hem 12 comprise two tabs 13, 14 which are normally identical and are each in the shape of an inverted vertical "U", in which one of the legs is connected to the outside peripheral surface 8*c* of cover 8 by a fabric that is beneficially ribbed to make attachment of the said tabs sufficiently stiff, and which are also placed approximately in the median horizontal plane P (FIG. 4*a*) of cover 8, symmetrically about the longitudinal axis of symmetry S (FIG. 3) of the said cover 8 extending as already mentioned, along a radius of the top 4 and which define a free space 15 between them; the resilient connecting tabs 13, 14, with a "U" inner shape enclose the top of the hem 12, with the arms being separated by approximately the diameter of the hem 12. Obviously, the width and also the thickness of the said tabs 13, 14 are designed to give reliable and sufficient clamping to the assembly.

Figure 4B:
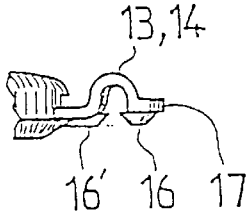

A stud 16 projecting within space 15 formed between the two connecting tabs 13, 14, from a horizontal strip 17 connecting the two free mold removal ends of the two connecting tabs 13, 14, extends from the inner edge 18 of the said strip 17 towards the lower part of the hem 12 until it comes into contact with the side wall 3 of receptacle 1 in order to work in cooperation with the two connecting tabs 13, 14, to complete locking and guidance of the cover 8 around hem 12, while minimizing friction during circular displacements of the same cover 8; beneficially, the stud 16 will be beveled on its lower face at its free end to further improve attachment in accordance with FIG. 4*d*; according to one alternative of the cover shown partially in FIG. 4*b*, locking of the cover 8 on hem 12 can be further improved by providing an additional stud 16 and another stud 16' facing stud 16, beveled in the same way and placed on the opposite internal part, i.e. on peripheral wall 8*c*; studs 16' and 16 located in the intermediate space between connecting tabs 13, 14 cause no mold removal problem, although they make a substantial contribution towards reducing friction.

According to a specific arrangement, the strip 17 supporting stud 16 will extend in the horizontal plane on a certain width to act as gripping device, not only for installing and removing the cover 8 on the hem 12, but also to facilitate the circular displacement from an open position until the closed position and vice versa.

According to another characteristic of the invention, the cover 8 is provided on its inner peripheral wall 8*d* with a projecting element as already mentioned, formed from a plate 19 that extends in the plane of the upper surface 20 of the cover 8 and from the said inner peripheral wall 8*d* along the longitudinal axis of symmetry S over a distance suitable for cooperating with pulling tab 7 to force penetration of the frangible closing device 5.

Figure 3:
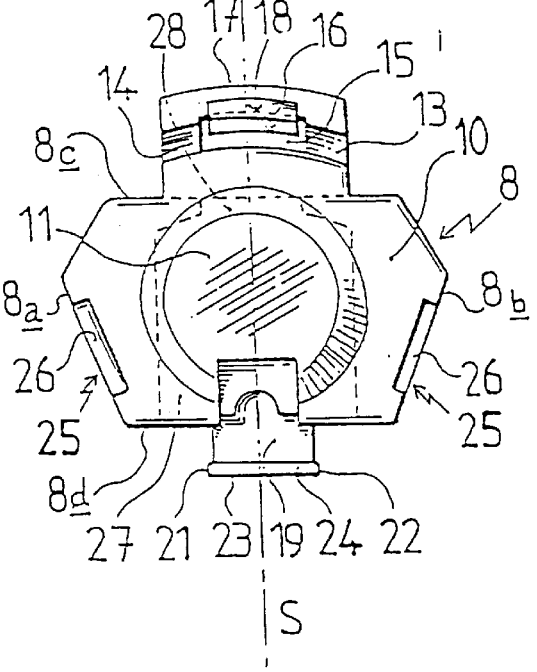
FIG. 3 is a bottom view of the same cover as on the previous Figure.

According to a particularly beneficial characteristic of the invention as shown in FIG. 5, the width of plate 9 is approximately equal to the distance separating the two connecting tabs 13, 14 and is fitted with retaining pins 21, 22 on each side of the end edge 23 of plate 19, capable of fitting inside the connecting tabs 13, 14, such that it is possible to articulate at least two covers 8 together either forwards or backwards, as shown for example in FIG. 5. Note that pins 21, 22 are inserted into tabs 13, 14 by pressing hard and slightly inclining plate 19. On the other side and as shown in FIG. 3, the outside edge 23 of plate 19 is reinforced by an overthickness of material 24 extending over the entire width below the said plate, which can beneficially be extended to the left and to the right to form retaining pins 21, 22; this overthickness 24 is designed to connect two covers 8 installed backwards as shown in FIG. 5, by stud 16 in one working with the overthickness 24 in the other. It is obvious that each cover made in this way can hinge onto other covers and finally form a chain, for example to make a game which remains to be designed.

For this purpose, and in accordance with a further characteristic, horizontal slits 25 with a width equivalent to space 15 could be provided in side walls 8*a*, 8*b* of cover 8 and on at least on one of the sides, into which plates 19 on other covers 8 can fit. Obviously, these slits 25 are made from recesses 26 with an opening on the lower face 10 of the cover 8 enabling vertical mold removal without the use of a mobile element in the mold. Obviously, it would be possible to create a slit 25 from recesses starting from the upper face 20, so that these cover assemblies 8 could be made in the same plane; similarly, two upper and lower recesses could be designed on each side of the cover if necessary, however provided that the notch on the upper face reduces the available area for the advertising printing as mentioned below.

It is then obvious that all assemblies can be done, at the will of each person, using the male and female parts of cover 8 thus formed, for example to form a mosaic such as that shown in FIG. 5, or a three-dimensional assembly as suggested in FIG. 6.

Figure 1:
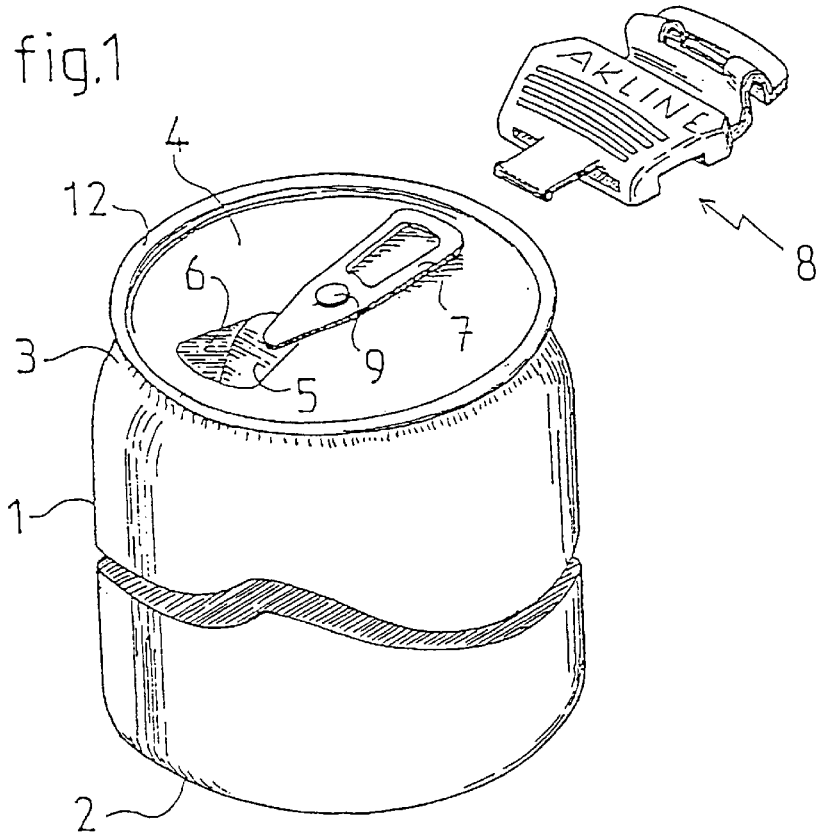
FIG. 1 is a perspective view of the reclosing cover according to the invention in the position of being inserted by the pulling tab.
Figure 2:
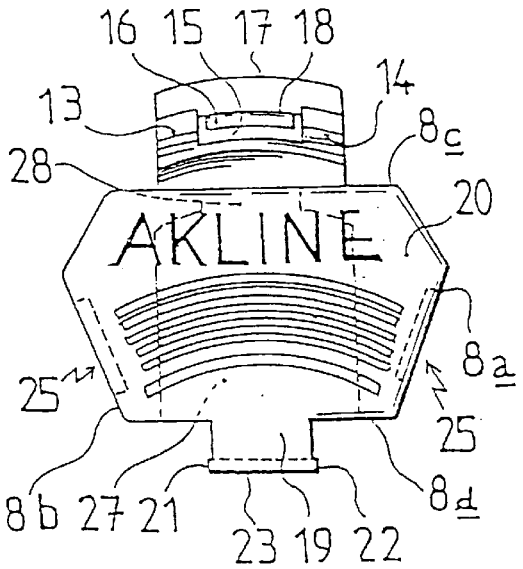
FIG. 2 is a top view of the cover in accordance with FIG. 1.

According to another fundamental purpose of this invention by which, as seen above, covers 8 of the required width can be molded without any risk of major defects for locking or guidance, it is proposed to make good use of the upper surface 20 of the cover 8 as a means of communication, for example to mark, engrave, silk screen print or ordinarily print advertising type messages, as shown for example in FIGS. 1 and 2.

Finally, according to a final characteristic of covers 8 according to the invention, the central cavity 27 containing the pulling tab 7 can be formed with a duct 28 as an extension along its axis of symmetry S towards the external peripheral wall 8*c* to open up into the intermediate space 15. In this way, the slide forming the central cavity can be removed smoothly from the mold by limiting the compression pressures that could break the said slide; unexpectedly, the presence of the pipe formed by cavities 27 and 28 creates, modifies or amplifies the characteristic noise caused by opening the receptacle, which provides a new undeniable additional benefit to the advertising effect of the cover mentioned several times.

Obviously, the closing cover as described above may also be used on any type of cylindrical receptacle of the same kind, and particularly to metal or plastic, or even reinforced cardboard or glass receptacles, provided that the said cover is adapted to the dimensions, geometry and the material of these other receptacles.

In particular, the cover according to the invention can be used for making advertising objects, for example during a marketing campaign, and the reuse of the technical parts of cover 8 for games purposes unexpectedly increases the attractive advertising nature of the said cover.

I claim:

1. A closing cover (8) for a receptacle comprising a cylindrical body (1), a bottom (2) and a crimped top (4) in which an opening (6) smaller than the said top is formed by means of a frangible closing device (5) that is pushed inside the receptacle by a pulling tab (7) acting as a lever being retained in the center and above the top (4) by a rivet (9), the cover (8) which is installed removably on the pulling tab (7) before and after opening (6) of the receptacle, to form a mobile tab pivoting around the rivet (9) on the upper part of the top (4) fitting firstly on the pulling tab (7) and secondly, by an external peripheral means, clipping around a peripheral crimping hem (12) on the top (4) of the receptacle body (1), the hem (12) acting as an external rail for circular displacement of the cover (8) which is moved in a circular manner, characterized in that the external peripheral means comprise two resilient connecting tabs (13, 14), approximately in the median horizontal plane (P) of the cover (8) and symmetrically located on each side of the longitudinal axis of symmetry S of the said cover (8) to form a space (15) in which a stud (16), projecting from a horizontal strip (17) connecting the free mold removal ends of the two tabs (13, 14) extends from the inner edge (18) of the said strip (17) towards the lower part of the hem (12) until coming into contact with the side wall (3) of the receptacle, in order to work in cooperation with the two resilient connecting tabs (13, 14) to lock and provide guidance around the hem (12) during circular displacements of the cover (8).

2. The cover (8) according to claim 1, characterized in a that lower cavity of the connecting tabs (13, 14) is in the general shape of an inverted vertical "U", in which the spacing of the legs is approximately equal to the diameter of the hem (12).

3. The cover according to claim 1, characterized in that the stud (16) is obtained by horizontal extension of the tab (13, 14) connecting strip (17).

4. The cover according to claim 1, characterized in that the stud (16) positioned under the hem (12) is shaped such that it is beveled at its inner face in contact with the side wall (3) of the receptacle.

5. The cover according to claim 1, characterized in that an additional stud (16'), beveled in the same way as the stud (16), is provided facing stud (16) on the side opposite the "U" of the connecting tabs (13, 14).

6. The cover according to claim 1, characterized in that there is a plate (19) along the prolongation of the plane of the upper surface (20) of the cover (8) that extends from the inside peripheral edge (8*d*) of the cover along the axis of the longitudinal plane of symmetry (S) along a distance sufficient to be able to cooperate with the pulling tab (7) by forcing penetration of the frangible closing device (5).

7. The cover according to claim 6 characterized in that the plate (19) has the same width as the distance separating the two connecting tabs (13, 14) and has retaining pins (21, 22) on each side of the end edge (23) of the plate (19), capable of being inserted in the inner "U" shaped cavity of each tab (13, 14), such that it is possible to hinge at least two of the covers (8) together.

8. The cover according to claim 6, characterized in that the end (23) of the plate (19) is equipped with a material overthickness (24) extending over the entire width of the plate (19) and below the plate, which can beneficially be extended towards the left and right to form retaining pins (21, 22), the said overthickness of the cover (8) being able to work in cooperation with studs (16, 16') on another like cover (8) to connect the two covers together back to back.

9. The cover according to claim 6 characterized in that there is a horizontal slit (26) on at least one side face (8*a*, 8*b*) of the cover (8) connecting the inner (8*d*) and outer (8*c*) peripheral walls to engage the retaining pins (21, 22) of a plate (19) on another cover.

10. The cover according to claim 1 characterized in that the surface of the cover (8) in contact with the receptacle top (4) is fitted with a bossing (11) that engages precisely into the opening (6) after the closing device (5) has been pushed in.

11. The cover according to claim 1, characterized in that the cavity (27) in which the pulling tab (7) is fitted extends in the same plane along the longitudinal axis of symmetry (S) towards the outer peripheral wall (8*c*) along a duct (28) leading into the space (15) between the connecting tabs (13, 14).

12. The cover (8) in accordance with claim 1 characterized in that at least the plane upper face (10), is used to place, engrave, silk screen print or print messages such as advertising messages.

* * * * *